US007757606B2

(12) United States Patent
Baintner et al.

(10) Patent No.: US 7,757,606 B2
(45) Date of Patent: Jul. 20, 2010

(54) APPARATUS AND METHOD FOR REGISTERING A POSITION OF A COMPONENT OF A PRESS

(75) Inventors: Alfons Baintner, Aystetten (DE); Nils-Hendric Schall, Augsburg (DE); Klaus Liepert, Westendorf (DE); Juergen Ziegler, Gersthofen (DE)

(73) Assignee: Man Roland Druckmaschinen AG, Augsburg (DE)

( * ) Notice: Subject to any disclaimer, the term of this patent is extended or adjusted under 35 U.S.C. 154(b) by 345 days.

(21) Appl. No.: 11/517,047

(22) Filed: Sep. 7, 2006

(65) Prior Publication Data

US 2007/0095229 A1 May 3, 2007

(30) Foreign Application Priority Data

Sep. 9, 2005 (DE) ..... 10 2005 042 932

(51) Int. Cl.

| | |
|---|---|
| ***B41F 1/34*** | (2006.01) |
| ***B41F 1/54*** | (2006.01) |
| ***B41F 1/66*** | (2006.01) |
| ***B41L 5/16*** | (2006.01) |
| ***B41L 15/14*** | (2006.01) |
| ***B41L 49/00*** | (2006.01) |
| ***B41L 5/12*** | (2006.01) |
| ***B41L 39/00*** | (2006.01) |
| ***B41L 47/56*** | (2006.01) |

(52) U.S. Cl. ..... 101/480; 101/484; 340/870.31; 324/207.22

(58) Field of Classification Search ..... 101/480, 101/483, 484, 485; 340/870.31; 324/174, 324/207.21, 207.22, 207.25

See application file for complete search history.

(56) References Cited

U.S. PATENT DOCUMENTS

| | | | | |
|---|---|---|---|---|
| 4,646,088 | A * | 2/1987 | Inoue | 340/870.31 |
| 5,865,120 | A | 2/1999 | Gross | |
| 5,924,362 | A | 7/1999 | Volz et al. | |
| 5,953,991 | A * | 9/1999 | Geissenberger et al. | 101/218 |
| 6,598,529 | B2 * | 7/2003 | Muller | 101/484 |
| 6,761,115 | B2 * | 7/2004 | Singer et al. | 101/484 |
| 6,848,361 | B2 * | 2/2005 | Metzler | 101/216 |
| 2002/0017212 | A1 * | 2/2002 | Muller | 101/484 |
| 2002/0094600 | A1 * | 7/2002 | Aburatani et al. | 438/100 |
| 2004/0089175 | A1 * | 5/2004 | Metzler | 101/216 |

FOREIGN PATENT DOCUMENTS

| | | | |
|---|---|---|---|
| DE | 1 037 584 | | 8/1958 |
| DE | 35 33 247 | A1 | 7/1986 |
| DE | 196 23 223 | A1 | 12/1997 |
| DE | 196 36 987 | A1 | 3/1998 |
| DE | 101 10 865 | A1 | 9/2001 |
| DE | 100 18 728 | A1 | 10/2001 |
| DE | 102 03 020 | A1 | 7/2003 |

* cited by examiner

*Primary Examiner*—Judy Nguyen
*Assistant Examiner*—Leo T Hinze
(74) *Attorney, Agent, or Firm*—Crowell & Moring LLP

(57) ABSTRACT

An apparatus and method for registering a position of a component of a press is disclosed. The press having a plurality of components that can rotate about a central longitudinal axis, such as a main drive shaft and press cylinders, at least one of these components being assigned at least one position registering device, which registers the angular position of the respective component. The, or each, position registering device is formed as a magnetic rotary encoder.

5 Claims, 2 Drawing Sheets

APPARATUS AND METHOD FOR REGISTERING A POSITION OF A COMPONENT OF A PRESS

This application claims the priority of German Patent Document No. 10 2005 042 932.7, filed Sep. 9, 2005, the disclosure of which is expressly incorporated by reference herein.

BACKGROUND AND SUMMARY OF THE INVENTION

The invention relates to a press, in particular a web-fed press.

Optical rotary encoders are normally used on presses in order to register the position of components that are driven rotationally or in rotation. Optical rotary encoders of this type have their own mechanical drive shaft and an independent mounting, which results in the disadvantage that the mechanical drive shaft of the rotary encoder has to be connected mechanically via complicated measures to a drive shaft of a component which is to be monitored with respect to its position. This mechanical connection between the drive shaft of the component driven rotationally or in rotation and the drive shaft of the optical rotary encoder is in this case carried out at an axial end position of the drive shaft of the component driven rotationally or in rotation and therefore at an axial position which is usually subjected to high torsional stresses. This can result in a reduction in the quality of the position detection. Further disadvantages of optical rotary encoders reside in the fact that the bearings of the same are subject to wear, and that optical encoders are highly sensitive to contamination. Therefore, according to the prior art, complicated encapsulation measures are required in order to protect the optical rotary encoder against contamination. In any case, however, complicated maintenance work is required on optical rotary encoders in order to clean the same from time to time.

Taking this as a starting point, the present invention is based on the problem of providing a novel type of press, in particular a novel type of web-fed press.

According to the invention, the, or each, position registering device is formed as a magnetic rotary encoder.

In the spirit of the present invention, it is proposed to use magnetic rotary encoders as position registering devices on rotatable components of a press. In this case, use is made of magnetic absolute value rotary encoders which do not have their own bearings. Such magnetic rotary encoders which do not have their own bearings are subjected to virtually no mechanical wear and therefore have a virtually unlimited mechanical lifetime. The magnetic rotary encoders are insensitive with respect to contamination. The position registration is carried out by means of the interplay of an index ring and a sensing head of the magnetic rotary encoder, the index ring being assigned to the rotating component and the sensing head being assigned to a stationary bearing element of the rotating component. The position registration with magnetic rotary encoders of this type is carried out without contact via an air gap between the index ring and the sensing head of the magnitude rotary encoder. The index ring can be arranged at virtually any axial position of the drive shaft of the rotating component, preferably at an axial position which is subjected to low torsional stress. A highly accurate measurement is possible in this way.

BRIEF DESCRIPTION OF THE DRAWINGS

Preferred developments of the invention emerge from the following description. Exemplary embodiments of the invention, without being restricted thereto, will be explained in more detail by using the drawings, in which.

DETAILED DESCRIPTION OF THE DRAWINGS

Figure 1:
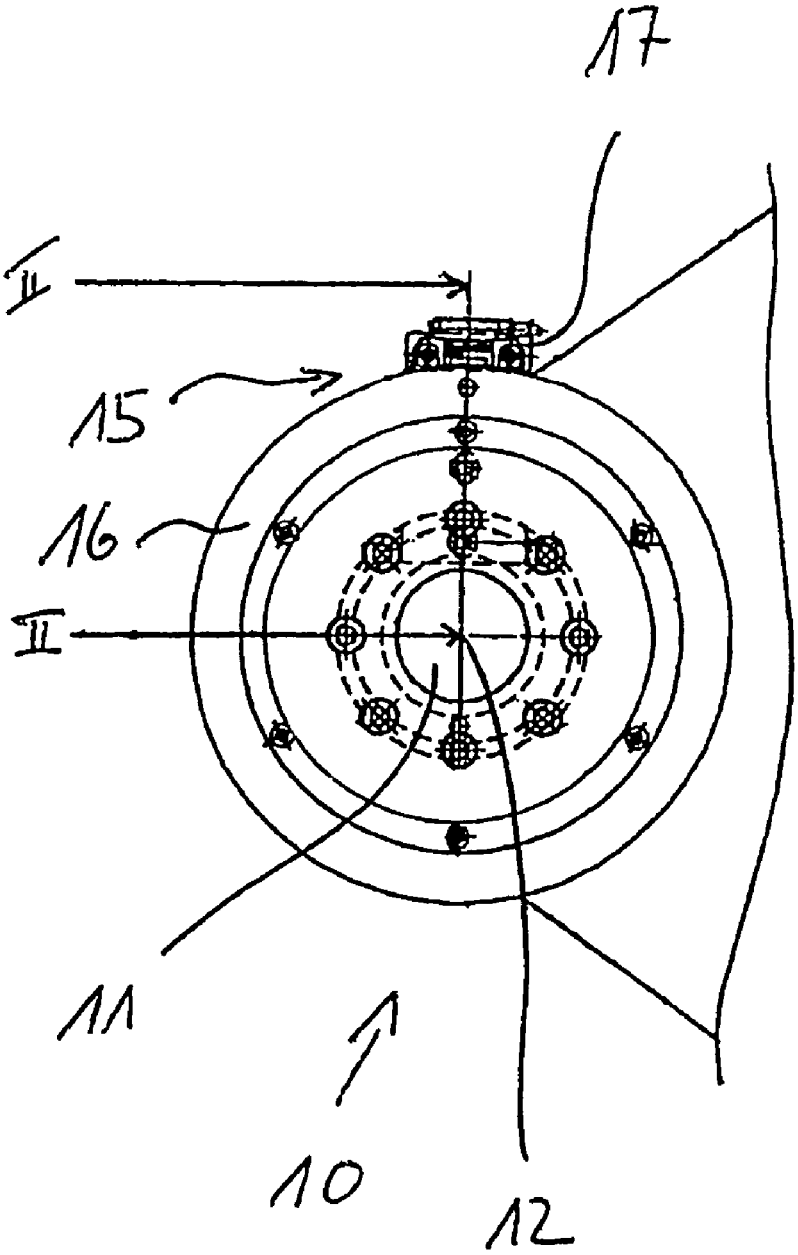
FIG. 1 shows a detail from a press according to the invention in the region of a rotatable component.
Figure 2:
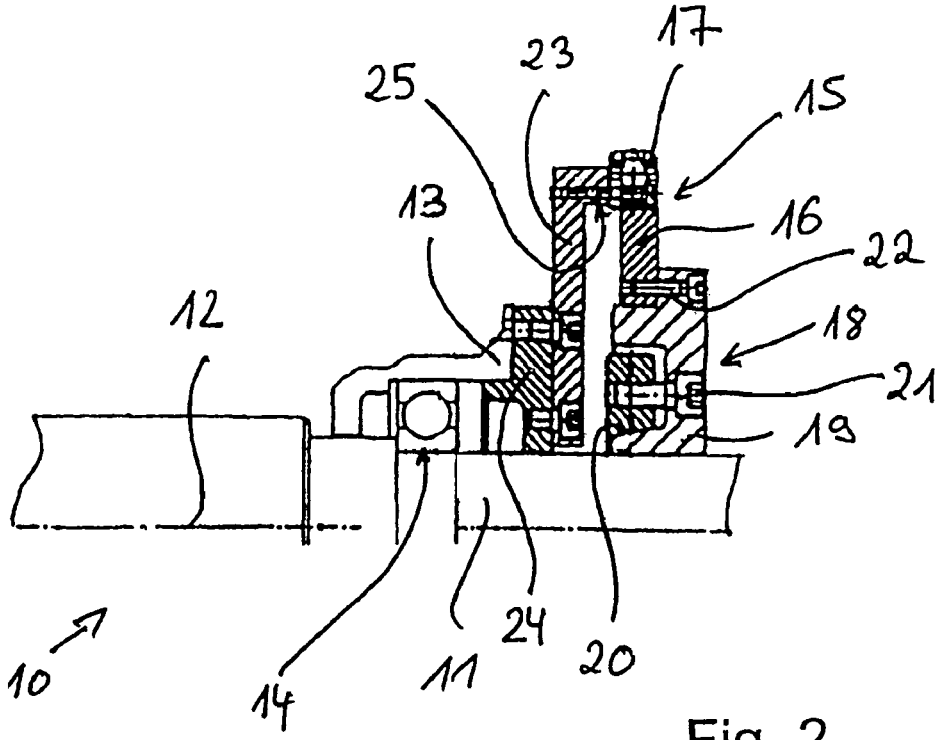
FIG. 2 shows a cross section through the arrangement of FIG. 1 along the section direction II-II according to FIG. 1.

FIGS. 1 and 2 show a detail from a press according to the invention in the region of a component driven in rotation or rotationally and constructed as a press cylinder 10. The press cylinder 10 has a drive shaft 11 and can be driven in rotation about a central longitudinal axis 12 via the drive shaft 11. The drive shaft 11 is mounted on a stationary bearing element 13. FIG. 2 shows a rotary bearing 14 for mounting the press cylinder 10 and the drive shaft 11 of the same on a stationary bearing element 13.

In order to register the position of the press cylinder 10, specifically in order to register its angular position, the press cylinder 10 is assigned at least one position registering device 15, in the spirit of the present invention the, or each, position registering device 15 being formed as a magnetic rotary encoder. The press cylinder 10 is preferably assigned two position registering devices 15 formed as magnetic rotary encoders, in order in this way to provide a possible redundant measurement and to increase the security against failure of the position registration of the press cylinder 10.

The, or each, magnetic rotary encoder is preferably formed as a magnetic absolute value rotary encoder without its own bearings. Such magnetic rotary encoders without their bearings have an index ring 16 and a sensing head 17. The index ring 16 is designed as a separate subassembly in the exemplary embodiment of FIGS. 1 and 2 and is fixed to the drive shaft 11 of the press cylinder 10.

As can be gathered in particular from FIG. 2, the index ring 16 is connected via a clamping ring connection 18 to the drive shaft 11 of the press cylinder 10 or coupled firmly to the shaft so as to rotate with it, so that the index ring 16, together with the press cylinder 10 and the drive shaft 11 of the same, rotates about the central longitudinal axis 12. The clamping ring connection 18 comprises two clamping ring elements 19 and 20, a first clamping ring element 19 being seated on the drive shaft 11 and holding a second clamping ring element 20; as a result of screws 21 being tightened, the second clamping ring element 20 pressing the first clamping ring element 19 against the drive shaft 11 and thus fixing the latter firmly to the drive shaft 11 so as to rotate with it. The index ring 16 is connected to the first clamping ring element 19 via screws 22.

The sensing head 17 of the position registering device 15, preferably formed as a magnetic absolute value rotary encoder, is assigned to the stationary bearing element 13 and fixed in its location on the stationary bearing element 13. For this purpose, the sensing head 17 is arranged on a carrier element 23 and, via the carrier element 23, is screwed to an attachment section 24 of the stationary bearing element 13. Here, the sensing head 17 is screwed to the stationary bearing element 13 or the carrier element 23 in such a way that a high degree of stiffness in the circumferential direction or direction of rotation is ensured, in order in this way to minimize oscillations of the sensing head 17 in the circumferential direction or direction of rotation of the press cylinder 10. This is achieved by a section 25 of the carrier element 23 which extends in the axial direction and to which the sensing head 17 has been screwed having a relatively short extent in the axial direction. This results in a stiff attachment in the circumferential direction of the sensing head 17 to the carrier element 23 of the stationary bearing element 13.

In the exemplary embodiment illustrated in FIGS. 1 and 2, the index ring 16 of the magnetic rotary encoder 15 is accordingly connected to the drive shaft 11 of the press cylinder 10 and rotates with the same. On the other hand, the sensing head 17 is screwed to the stationary bearing element 13.

Between the index ring 16 and the sensing head 17 of the magnetic rotary encoder, an air gap of the order of magnitude of a few tenths of a millimeter is formed. The sensing and therefore the registration of the position is carried out without contact via this gap.

The index ring 16 of the position registering device 15, designed as a separate subassembly in the exemplary embodiment of FIGS. 1 and 2, can be arranged via the clamping ring connection 18 at virtually any desired axial position of the drive shaft 11 or of the component driven in rotation. In this case, the index ring 16 is preferably firmly connected to the drive shaft 11 so as to rotate with it at an axial position which is subjected to little torsional stress. In this way, a high quality of the measured result can be ensured.

In the exemplary embodiment of FIGS. 1 and 2, the axial position of the sensing head 17 is predefined by the stationary bearing element 13. In order to adjust the position registering device 15, the axial position of the index ring 16 on the drive shaft 11 relative to the sensing head 17 can be adjusted. For this purpose, it is merely necessary for the clamping ring element 19 to be displaced relative to the drive shaft 11 and also relative to the stationary sensing head 17 with the clamping ring connection 18 released, in order then, following adjustment, to be fixed firmly to the drive shaft 11 so as to rotate with it in the respective axial position, by the screws 21 being tightened.

Figure 3:
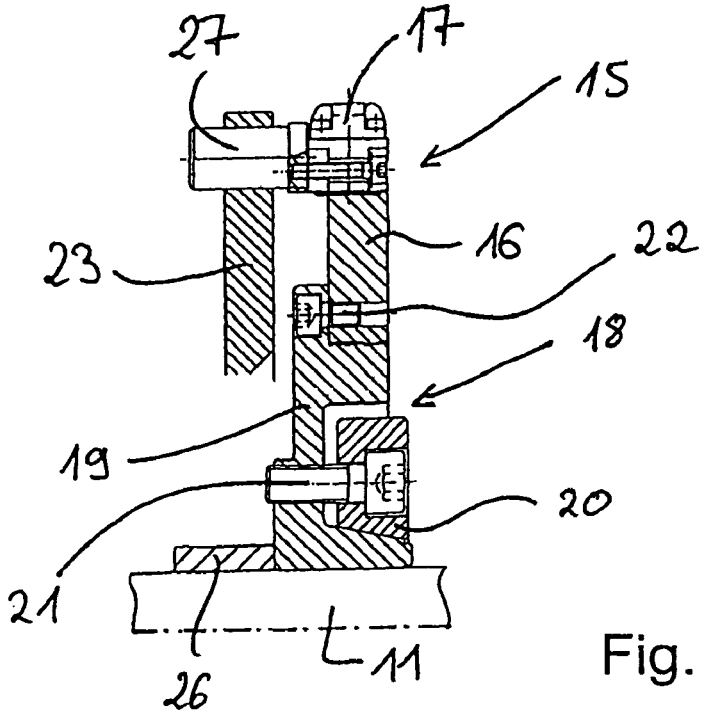
FIG. 3 shows a cross section through an alternative configuration of the invention in an illustration analogous to FIG. 2.

Alternatively, it is also possible to predefine the axial position of the index ring 16 on the drive shaft 11 and to displace the sensing head 17 relative to the index ring 16 in order to adjust the position registering device 15. Thus, FIG. 3 shows an exemplary embodiment of the invention in which the axial position of the index ring 16 on the drive shaft 11 is predefined via a stop 26 assigned to the drive shaft 11. In order to adjust the position registering device 15, the sensing head 17 then has to be aligned relative to the index ring 16, for this purpose the sensing head 17 being guided via a guide element 27 such that it can be displaced in the axial direction in the carrier element 23.

At this point, it should be pointed out that the index ring 16 has an internal diameter which is matched to the external diameter of the drive shaft 11 or the press cylinder 10.

The measured signal provided by the position registering devices 15 can be used for the purpose of implementing drive control for the press cylinder 10 to which the position registering device 15 is assigned. Alternatively or in combination with this, it is also possible to use the measured signal from the position registering device 15 which is assigned to the press cylinder 10 for the drive control of another component driven in rotation or rotationally. In this case, the measured signal from the position registering device 15 represents a master signal for another component of the press.

In the exemplary embodiments shown by FIGS. 1 to 3, it was assumed that the position registering device is assigned to a press cylinder driven in rotation. It should be pointed out that the invention can also be used on other components of a press that are driven in rotation, for example on a main drive shaft of a press, which is also designated the master shaft. In this case, with the aid of a magnetic rotary encoder, the angular position of the main drive shaft is monitored by means of measurement, it being possible for drive control for the main drive shaft and/or a drive shaft for other units of the presses, for example a folder, to be implemented on the basis of the measured signal provided.

In the exemplary embodiments shown, the index ring 16 of the magnetic rotary encoder is in each case designed as a separate subassembly. In a departure from this, it is also possible for the index ring 16 to be an integral constituent part of the drive shaft 11, accordingly for the drive shaft 11 to bear an appropriate magnetic index directly.

With the present invention, a position measurement or angular position measurement of rotating components of a press is made possible, which measurement does not have its own bearings and is insensitive to contamination. Use is preferably made of magnetic absolute value rotary encoders without their own bearings, which register the angular position of the rotating components at every time. As a result of the virtually unlimited mechanical lifetime of such position registering devices, only little expenditure on maintenance for the same is required.

LIST OF REFERENCE SYMBOLS

10 Press cylinder
11 Drive shaft
12 Central longitudinal axis
13 Bearing element
14 Rotary bearing
15 Position registering device
16 Index ring
17 Sensing head
18 Clamping ring connection
19 Clamping ring element
20 Clamping ring element
21 Screw
22 Screw
23 Carrier element
24 Attachment section
25 Section
26 Stop
27 Guide element The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A press, comprising:

a rotatable component, wherein the rotatable component is a drive shaft of a press cylinder of the press; and a position registering device, wherein the position registering device registers an angular position of the component and wherein the position registering device is a magnetic rotary encoder including an index ring that is fixed to the drive shaft of the press cylinder and a sensing head disposed on a stationary bearing element of the drive shaft;

wherein the index ring is fixed to the drive shaft of the press cylinder by a clamping ring connection including a first clamping ring element seated on the drive shaft and a second clamping ring element disposed within the first clamping ring element, wherein the index ring is connected to the first clamping ring element and wherein the first clamping ring element is fixed to the drive shaft by the second clamping ring element pressing the first clamping ring element against the drive shaft;

and further wherein the sensing head is disposed on the stationary bearing element by a carrier element attached to the stationary bearing element, wherein the sensing head is attached to an axially extending section of the carrier element.

2. The press according to claim 1, wherein an air gap is defined between the index ring and the sensing head and wherein the position registering device registers the angular position of the drive shaft across the air gap.

3. A method for registering a position of a component of a press, comprising the steps of:

disposing an index ring of a position registering device on a rotatable component, wherein the rotatable component is a drive shaft of a press cylinder of the press;

disposing a sensing head of the position registering device on a stationary bearing element of the drive shaft; and registering an angular position of the drive shaft across an air gap defined by the index ring and the sensing head by the position registering device;

wherein the index ring is fixed to the drive shaft of the press cylinder by a clamping ring connection including a first clamping ring element seated on the drive shaft and a second clamping ring element disposed within the first clamping ring element, wherein the index ring is connected to the first clamping ring element and wherein the first clamping ring element is fixed to the drive shaft by the second clamping ring element pressing the first clamping ring element against the drive shaft;

and further wherein the sensing head is disposed on the stationary bearing element by a carrier element attached to the stationary bearing element, wherein the sensing head is attached to an axially extending section of the carrier element.

4. The method according to claim 3, wherein the index ring is disposed at an axially intermediate position on the rotatable drive shaft.

5. The method according to claim 3, wherein the position registering device is a magnetic rotary encoder.

* * * * *